United States Patent [19]

Law et al.

[11] 4,129,922

[45] Dec. 19, 1978

[54] ARM TOP COVER HINGE FOR SEWING MACHINES

[75] Inventors: Joseph P. Law, Scotch Plains; Alfred R. Mack, Bayonne, both of N.J.

[73] Assignee: The Singer Company, New York, N.Y.

[21] Appl. No.: 880,736

[22] Filed: Feb. 24, 1978

[51] Int. Cl.[2] ..... E05D 11/10

[52] U.S. Cl. ..... 16/139; 16/180; 16/DIG. 13; 312/30; 112/258

[58] Field of Search ..... 16/128 R, 139, 142, 16/145, 163, 168, 169, 171, 172, 173, 174, 175, 176, 177, 178, 179, 180, DIG. 13; 220/335, 336, 337, 339, 340, 343; 312/208, 26, 30; 112/158 R, 258, 259

[56] References Cited

U.S. PATENT DOCUMENTS

| | | | |
|---|---|---|---|
| 3,027,857 | 4/1962 | Johnson | 112/158 R X |
| 3,465,381 | 9/1969 | Lawrie et al. | 16/142 |
| 3,952,369 | 4/1976 | Erickson | 16/171 |

*Primary Examiner*—Werner H. Schroeder
*Assistant Examiner*—Moshe I. Cohan
*Attorney, Agent, or Firm*—Michael H. Wallach; Robert E. Smith; Edward L. Bell

[57] ABSTRACT

A hinge for the lid contained on the arm top cover of a sewing machine which comprises a pair of cam shaped pivot pins molded into the arm top cover and a pair of saddles molded into the lid and adapted to receive the pivot pins. A plastic spring havng a pivot pin embracing tab at each end is removably fastened to the lid. The plastic spring imparts a "snapping" action to restrain the lid in an open or closed position.

3 Claims, 6 Drawing Figures

ARM TOP COVER HINGE FOR SEWING MACHINES

BACKGROUND OF THE INVENTION

1. Field Of The Invention

This invention relates to sewing machines in general and more particularly to sewing machines having hinged lids enclosing chambers therein.

2. Description Of The Prior Art

The use of various forms of hinges to join a lid to a body enclosing a chamber is well known in the prior art. See for example U.S. Pat. Nos. 3,027,857 to Johnson and 3,465,381 to Lawrie et al. One problem associated with prior known hinges applied to sewing machines is that they require additional hinge mechanism parts to have the lid resistively restrained in an open or closed position. Another problem of prior known hinges is that they often utilize parts formed from spring steel having resilient qualities, which are costly to produce. Still another problem associated with prior known hinges is that their additional parts require extra time to assemble.

SUMMARY OF THE INVENTION

The principal object of the invention is to provide an improved hinge mechanism for sewing machines that requires a minimum number of parts which are easily manufactured and assembled.

Another object is to provide a hinge mechanism for sewing machines which will support a chamber enclosing lid in two definite positions.

Another object is to provide a hinge mechanism for sewing machines in which the pivot pins are integrally molded into the stationary portion of the arm top cover.

Another object is to provide a hinge which will retain a lid in one of two definite positions without requiring a metal spring.

The disclosed objects and other advantages of the invention are obtained by molding a pair of cam shaped pivot pins into the stationary portion of the arm top cover of a sewing machine. The lid portion contains two "U" shaped saddles integrally molded therein, and adapted to embrace the cam shaped pivot pins. A plastic spring is formed with resilient "L" shaped tabs at either end thereof and is secured to the lid with a fastener means. The "L" shaped tabs embrace the pivot pins and restrain them against the "U" shaped saddles. The "L" shaped tabs are positioned to rest against substantiallyy flat surfaces of the cam shaped pivot pins when the lid is in an open or closed position. During the transition between the open and closed positions the "L" shaped tabs are biased by the lobes formed on the pivot pins. The "L" shaped tabs are thereby biased away from the body of the plastic spring. Releasing the lid in any position other than the fully open or closed positions results in the movement of the lid to the nearest rest position as a result of the action of the biased tabs acting against the cam shaped pivot pins. When the lid reaches a rest position the "L" shaped tabs thereafter rest against the flat surfaces formed on the pivot pins, thereby restraining the lid from extraneous movement.

BRIEF DESCRIPTION OF THE DRAWINGS

The above and other objects of this invention will be evident from an understanding of the preferred embodiment which is hereinafter set forth in such detail as to enable those skilled in the art readily to understand the function, operation, construction, and advantages of it when read in conjunction with the accompanying drawings in which.

DESCRIPTION OF THE PREFERRED EMBODIMENT

Figure 1:
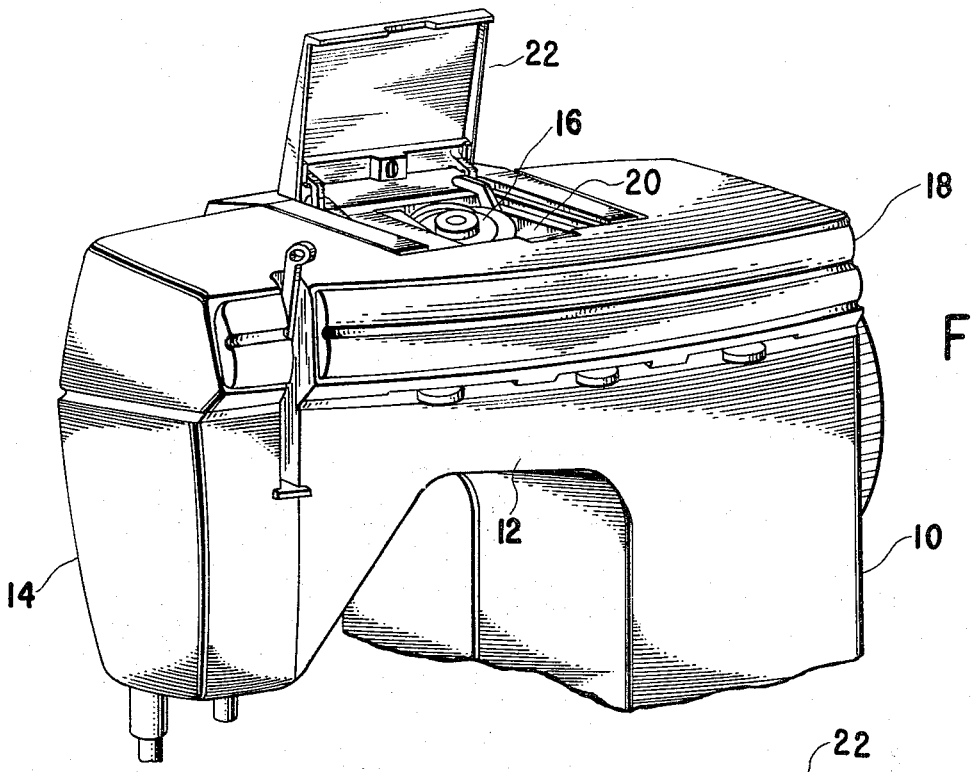
FIG. 1 is a perspective view of a portion of a sewing machine having a lid fastened to the arm top cover with the hinge of this invention.
Figure 2:
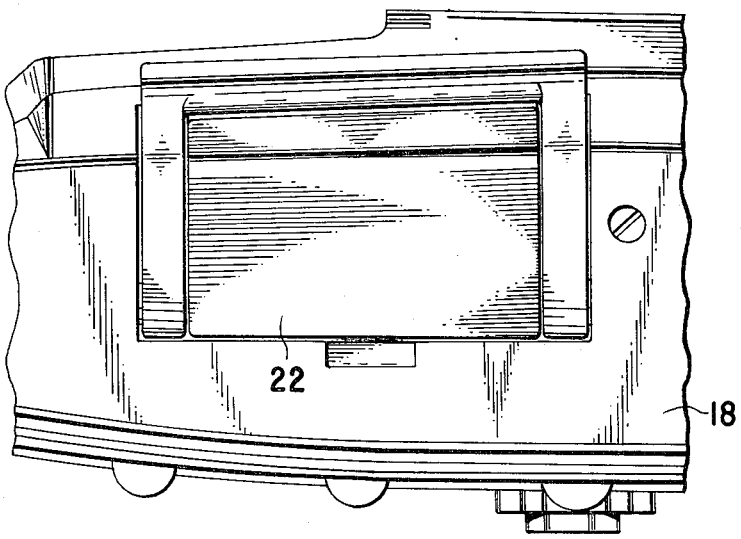
FIG. 2 is an overhead view of a portion of the arm of the sewing machine shown in FIG. 1.

Referring to FIG. 1 of the drawings, this invention is shown applied to a sewing machine have a standard 10 supporting a bracket arm 12 and terminating in a sewing head 14. The bracket arm 12 contains a cam stack 16 which is adapted to influence the stitch pattern produced by the sewing machine. The top of the bracket arm 12 is covered with an arm top cover 18. A chamber 20 is formed in the top cover 18 to permit convenient access to and adjustments to be made to the stitch influencing cam stack 16. A lid 22 is pivotally hinged to the arm top cover 18 for swinging upwardly about a horizontal axis at the back of the top cover. FIG. 2 shows the lid 22 enclosing the chamber 20 formed in the arm top cover 16.

Figure 3:
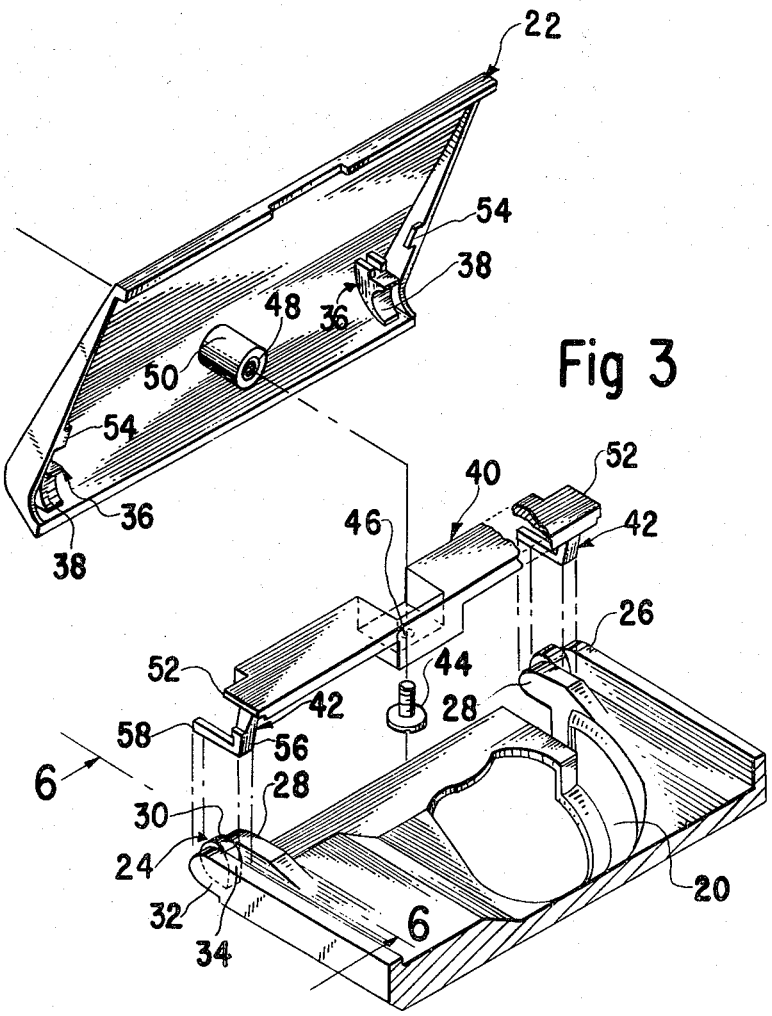
FIG. 3 is a disassembled perspective view of the lid of a sewing machine having a hinge constructed in accordance with the teachings of the invention applied thereto.
Figure 6:
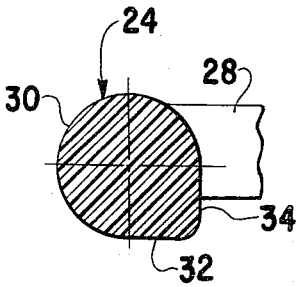
FIG. 6 is a partial section view taken substantially through line 6 — 6 of FIG. 3 showing the shape of the pivot pins which pivotally support the lid.

FIG. 3 shows a pair of pivot pins 24 supported between the chamber walls 26 and the pivot pin supports 28. Preferably the pivot pins and the pivot pin supports are molded into the arm top cover at the same time. FIG. 6 shows that the pivot pins 24 are cam shaped and consist of an arcuately cylindrical segment 30, a substantially horizontal surface 32, and a substantially vertical surface 34. A cam lobe is formed at the intersection of the horizontal surface 32 and the vertical surface 34. FIG. 3 also shows the lid 22 having a pair of saddles 36 preferably formed integrally therewith. The saddles contain the substantially arcuately concave surfaces 38 for embracing the arcuately cylindrical portion 30 of the pivot pins. The arcuate cylindrical portion 30 of the pivot pin is so formed to remain in sliding contact with an arcuate concave surface 38 of the saddle 36 when the lid 22 is in its closed position and when the lid 22 has been rotated upwardly to its open position.

A plastic spring 40 is formed with "L" shaped tabs 42 at the ends thereof to embrace the pivot pins 24. The spring is fastened to the lid 22 by a fastener 44 which passes through a bore 46 contained in the spring and engages a threaded aperture 48 contained in a boss 50 which is preferably formed as an integral part of the lid 22. The ends 52 of the plastic spring 40 are retained against the lid 22 by a pair of tabs 54 which are preferbly formed as an integral part of the lid 22. The "L" shaped tabs 42, which are formed at the ends of the plastic spring, have a spacer 56 extending perpendicular from one surface of the plastic spring and a pivot pin embracing finger 58 extending from the spacer 56 in covering relation to the plastic spring 40. The plastic spring 40 is attached to the lid 22 by engaging the spring ends 52 between the lid 22 and the tabs 54 thereby trapping the pivot pins 24 between the pivot pin engaging surfaces 38 and the pivot pin embracing fingers 58.

Figure 4:
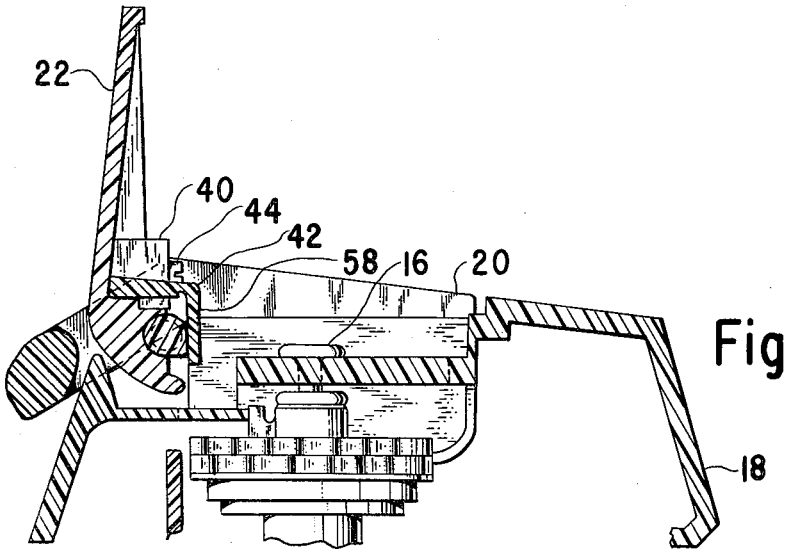
FIG. 4 is a cross sectional view of a portion of the arm of a sewing machine showing a lid in the open position.
Figure 5:
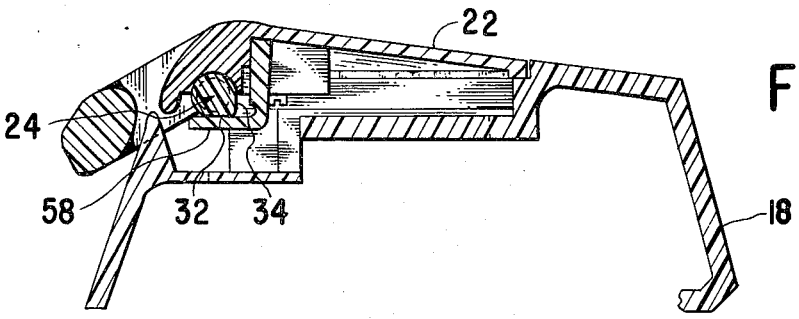
FIG. 5 is a view similar to FIG. 4 with the lid in the closed position.

The operation of the hinge of this invention may be obsered by reference to FIGS. 4 and 5 which respectively shown a lid 22 attached to an arm top cover 18 in an open and a closed position. FIG. 4 shows that when the lid 22 is open, the pivot pin embracing fingers 58 are resting against the vertical pivot pin surfaces 34 thereby preventing any unwanted movement of the lid 22. When the lid 22 is rotated downwardly to move it to a closed position as shown in FIG. 5, the pivot pin embracing fingers 58 pass over the lobes formed by the intersection of the substantially horizontal surfaces 32 of the pivot pins 24 and the substantially vertical surfaces 34 of the pivot pins 24, thereby causing the pivot pin embracing fingers 58 to be bent away from the plastic spring 40. The continued rotation of the lid 22 results in the pivot pin embracing fingers 58 contacting the horizontal surfaces 32 with the corresponding relaxation of the bend in the pivot pin embracing fingers 58 caused by contact with the lobes formed between the vertical surfaces 34 and the horizontal surfaces 32. When the lid 22 is in a horizontally closed position as shown in FIG. 5, the pivot pin embracing fingers 58 are resting against the horizontal surfaces 32 of the pivot pins. If the lid is released in any position other than when it is fully opened or closed, the energy stored in the pivot pin embracing fingers 58 as a result of being bent by the lobes contained on the pivot pins 24 will result in the lid 22 moving to the closer of the open of closed position to relieve the bend in the pivot pin embracing fingers 58.

Numerous alternations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A hinge mechanism for a lid of a sewing machine arm top cover comprising a pair of pivot pins attached to said arm top cover and having a substantially vertical and a substantially horizontal surface formed thereon for defining an open and a closed position of said lid, as a lobe joining said surfaces at one end and an arcuate cylindrical surface joining said surfaces at a second end, a pair of concave saddles formed on said lid for rotatably engaging said arcuate cylindrical portion of said pivot pins, a spring means embracing said pivot pins and fastened to said lid, said spring means being so disposed to be unbiased by said horizontal surface of said pivot pins when said lid is in a closed position and unbiased by said vertical surface of said pivot pins when said lid is in an open position, said spring means being biased by said lobes of said pivot pins when said lid is in an intermediate position, thereby causing said lid to arcuately pivot to a position whereby the bias applied to said spring means by said lobes is relieved.

2. A hinge mechanism for the lid of a sewing machine as set forth in claim 1 wherein said saddles are integrally formed as a part of said lid.

3. A hinge mechanism for the lid of a sewing machine as set forth in claim 1 wherein said spring means are molded from a synthetic plastic and include a plurality of pivot pin embracing means depending from the ends thereof and integrally formed on said spring, said pivot pin embracing means operatively restraining said pivot pins between said concave saddles and said spring means.

* * * * *